United States Patent [19]

Lindblad

[11] Patent Number: 4,893,382

[45] Date of Patent: Jan. 16, 1990

[54] ARRANGEMENT FOR A FASTENER FOR A STRAINING DEVICE

[76] Inventor: Lennart Lindblad, Hedåsgatan 16, S-447 00 Vårgårda, Sweden

[21] Appl. No.: 351,329

[22] Filed: May 4, 1989

Related U.S. Application Data

[63] Continuation of Ser. No. 88,130, filed as PCT SE86/00519 on Nov. 13, 1986, published as WO87/03177 on Jun. 4, 1987, abandoned.

[30] Foreign Application Priority Data

Nov. 27, 1985 [SE] Sweden ..... 8505607

[51] Int. Cl.[4] ..... A44B 11/00

[52] U.S. Cl. ..... 24/200; 24/308

[58] Field of Search ..... 24/23 B, 68 E, 68 F, 24/308, 309, 169, 197–200

[56] References Cited

U.S. PATENT DOCUMENTS

| | | | |
|---|---|---|---|
| 413,382 | 10/1889 | Bassett | 24/200 |
| 804,788 | 11/1905 | Barabasz | 24/200 |
| 1,718,291 | 6/1929 | Guenther | 24/23 B X |
| 2,862,271 | 12/1958 | Harley | 24/197 |
| 3,678,541 | 7/1972 | Lefkowitz | 24/200 |
| 4,387,490 | 6/1983 | Blackburn et al. | 24/198 X |
| 4,525,901 | 7/1985 | Krauss | 24/197 X |

FOREIGN PATENT DOCUMENTS

| | | | |
|---|---|---|---|
| 153838 | 11/1950 | Australia | 24/198 |
| 68041/81 | 9/1981 | Austria . | |
| 331074 | 12/1920 | Fed. Rep. of Germany | 24/169 |
| 544638 | 9/1922 | France . | |
| 1328435 | 4/1963 | France | 24/197 |
| 396932 | 10/1977 | Sweden . | |

*Primary Examiner*—James R. Brittain

*Attorney, Agent, or Firm*—Balogh, Osann, Kramer, Dvorak, Genova & Traub

[57] ABSTRACT

A buckle for a straining device, having a direction-changing bar adapted for the straining device, the bar extending over an area of an unobstructed space and arranged to permit the straining device to be passed through in a doubled-over form and a clamping stop interacting with the straining device, wherein the bar is formed from a plate which is bent over so that the direction-changing bar on the plate and supported by it is supported above the unobstruced space in the buckle. Among other things, the buckle is made from few parts and which function effectively. Extending between the direction-changing bar and the plate are uprights which are arranged to maintain associated direction-changing bars supported at all times at a level above the unobtstructed space in the buckle so that a part of the straining device can be passed freely around the bar in question.

4 Claims, 4 Drawing Sheets

ARRANGEMENT FOR A FASTENER FOR A STRAINING DEVICE

This is a continuation of co-pending application Ser. No. 088,130, filed as PCT SE 86/00519 on Nov. 13, 1986, published as W087/03177 on Jun. 4, 1987, abandoned.

The present invention relates to an arrangement for a fastener for a straining device, which fastener comprises a direction-changing bar adapted for the straining device, which bar extends over the area of an unobstructed space arranged to permit the straining device to be passed through in doubled-over form, and a clamping stop capable of interacting with the straining device, which bar is also constituted by a part formed from the fastener which is bent over so that the direction-changing bar connected to the fastener and supported by it can be supported above said unobstructed space in the fastener.

The principal object of the present invention is primarily to make available an arrangement of the kind indicated above which enables a fastener to be made available simply and efficiently, but which is also able to function effectively and reliably.

Said object is achieved by means of an arrangement in accordance with the present invention, which is characterized essentially in that extending between the direction-changing bar and the fastener are uprights which are so arranged as to maintain the associated direction-changing bars supported at all times at a level above said unobstructed space in the fastener so that the part concerned of the straining device can be passed freely around the bar in question.

The invention is described below in the form of a number of preferred illustrative embodiments, in conjunction with which reference is made to the accompanying drawings, in which.

Figure 1:
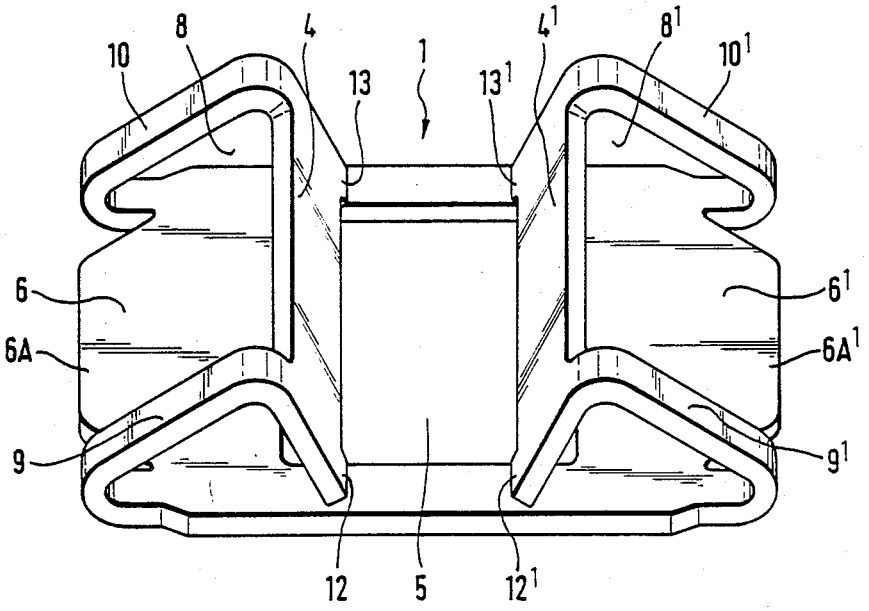
FIG. 1 shows a perspective view of a first preferred embodiment of a fastener.
Figure 2:
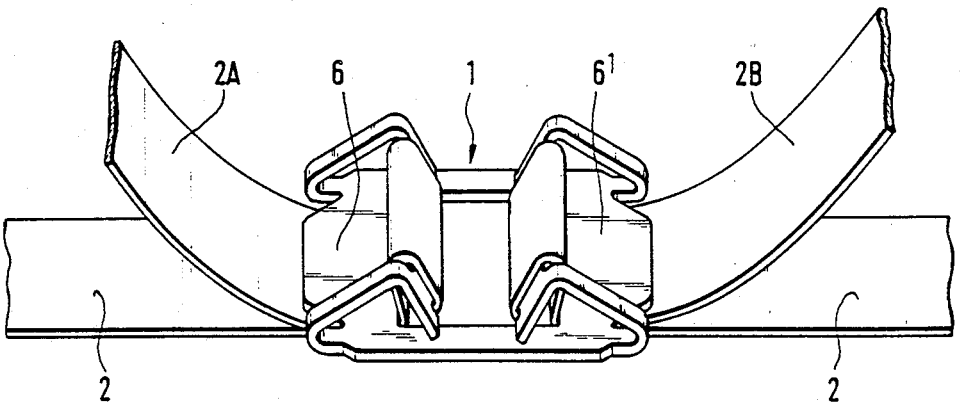
FIG. 2 shows the fastener with towing devices in position.
Figure 8:
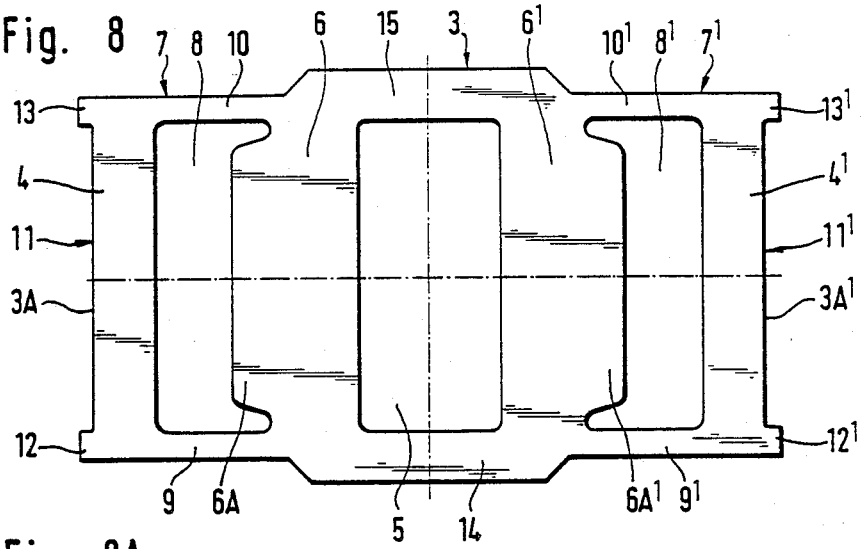
FIGS. 8–8D show in diagrammatic form the procedure for manufacturing the fastener shown in FIGS. 1 and 2.
Figure 8A:
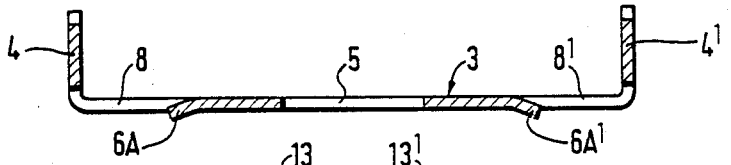
Figure 8B:
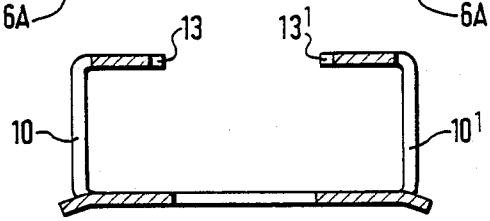
Figure 8C:
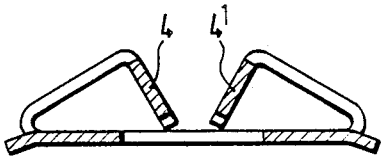

A first embodiment, as shown in FIGS. 1 and 2, of a preferred fastener 1, which is intended to be capable of interacting with in particular strap-shaped parts 2A, 2B of a straining device 2, is appropriately manufactured from a plate 3 made of metal or some other suitable material, as shown in FIG. 8. Said fastener 1 is intended to comprise a direction-changing bar 4, $4^1$ adapted for the straining device 2, which bar extends over the area of a centrally situated unobstructed space 5 extending through the plate 3, which space is intended to permit the straining device 2 to be passed through it in such a way as to cause the bar 4, $4^1$ in question to be deflected downwards and the straining device to be doubled-over, as clearly illustrated in FIG. 2. The direction-changing bar 4, $4^1$ also extends over the area of a clamping stop 6, $6^1$ capable of interacting with the straining device 2.

The direction-changing bar 4, $4^1$ is constituted by a part 7, $7^1$ formed from the fastener 1 and its plate 3, which part contains a cavity 8, $8^1$ which extends through the fastener plate 3 and which is situated in an area between the direction-changing bar 4, $4^1$ and the clamping stop 6, $6^1$. Said part 7, $7^1$ of the fastener is bent so that uprights 9, 10, $9^1$, $10^1$ situated preferably at each end of the direction-changing bar 4, $4^1$ and connected to the bar 4, $4^1$ extend from the area adjacent to the clamping stop 6, $6^1$ and inwards over the fastener plate 3, so that the direction-changing bar 4, $4^1$ is supported above said unobstructed space 5 in the fastener. The uprights 9, 10, $9^1$, $10^1$ appropriately extend at an angle inwards over the fastener plate 3, preferably at approximately 45°.

The direction-changing bar 4, $4^1$ is appropriately constituted by a flat part 11, $11^1$ of the plate 3, which part is situated between said cavity 8, $8^1$ and the outer end 3A, $3A^1$ of the plate. Said bar-forming part 11, $11^1$ of the plate is appropriately set at an angle in relation to the uprights 9, 10, $9^1$, $10^1$ and the fastener plate 3.

The two uprights 9, 10, $9^1$, $10^1$ at the direction-changing bar 4, $4^1$ in question are preferably so arranged as to extend out past the associated bars 4, $4^1$ so as to form stop supports 12, 13, $12^1$, $13^1$ on interaction with the fastener plate 3.

Figure 8D:
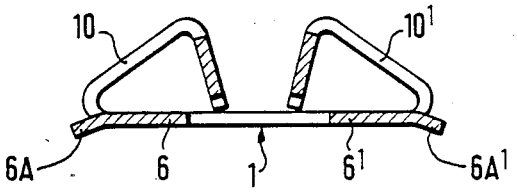

Said clamping stop 6, $6^1$ may exhibit an outer, tongue-shaped part 6A, $6A^1$ which is bent in such a way as to extend in a direction downwards and outwards from the fastener plate 3, as shown in FIG. 8D.

The function of the straining device fastener 1 in question is such that, when the strap parts, etc., 2A, 2B are passed around a bar 4, $4^1$ and back between the clamping stop 6, $6^1$, the strap, etc., 2 is retained effectively and reliably at the place of use of the plate 3, for example around a load, after having been made fast. The strap 2 is caused by the tensile effect within the strap 2 to pivot the direction-changing bar 4, $4^1$ downwards towards the centre of the fastener so that the supports 12, 13, $12^1$, $13^1$ preferably come into contact with the upper side of the two frame pieces 14, 15 which extend to either side of the unobstructed space 5 and adjacent to the clamping stop 6, $6^1$. Because the strap 2 and the clamping stop 6, $6^1$ extend in essentially the same direction along the buckle 1, the strap parts 2A, 2B are securely clamped between the strap 2 and the clamping stop 6, $6^1$. By raising the buckle 1 at either end, for example the end from which the strap part 2A projects, the clamping interaction between the strap 2 and the clamping stop 6 will cease so that the strap part 2A can be released from the buckle 1.

Figure 3:
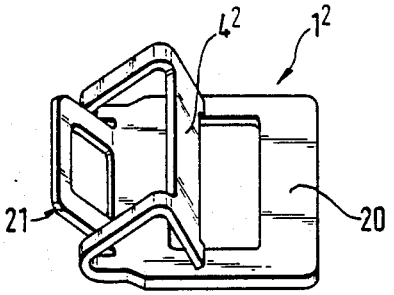
FIG. 3 shows a second embodiment of a fastener.

The locking buckle $1^2$ illutrated in FIG. 3 differs from the previously described buckle 1 in that it exhibits at one of its ends a bar 20 suitable for the permanent securing of a strap, and in that a mechanism 21 suitable for the pivoting actuation of the buckle $1^2$ is arranged at the side of the buckle $1^2$ which supports a direction-changing bar $4^2$. Said mechanism 21 can be so arranged as to be actuated manually or by means of tools in order to raise the buckle $1^2$ from a strap or some other towing device for the purpose of releasing same.

Figure 4:
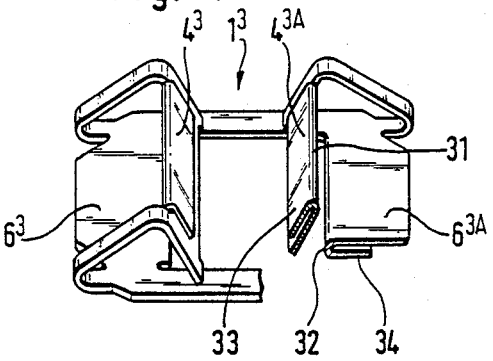
FIG. 4 shows a third embodiment of a fastener as a partially cut-away view.

Illustrated in FIG. 4 is a buckle $1^3$ which, like the buckle 1, exhibits two direction-changing bars $4^3$, $4^{3A}$ each capable of interacting with parts of the towing device arriving from different directions and capable of being attached temporarily to the buckle. At least one of said bars $4^3$, $4^{3A}$ and/or a clamping stop $6^3$, $6^{3A}$ exhibits an edge 31, 32 which interacts with a towing device, which edge exhibits a protective part which can be constituted by a part 33, 34 formed from the fastener plate, for example by stamping, and bent over, upon which the towing device can act and is thus, amongst other things, prevented from becoming worn to any significant degree.

Figure 5:
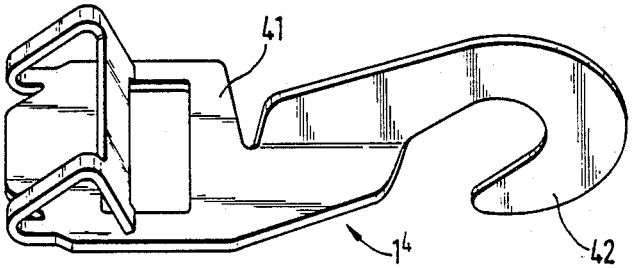
FIG. 5 shows a fourth embodiment of a fastener.
Figure 6:
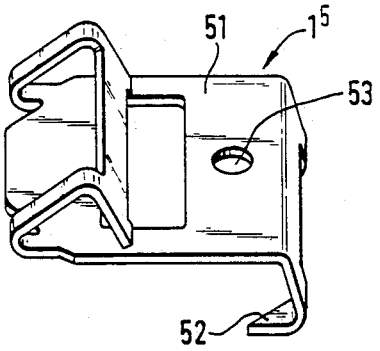
FIG. 6 shows a fifth embodiment of a fastener.
Figure 7:
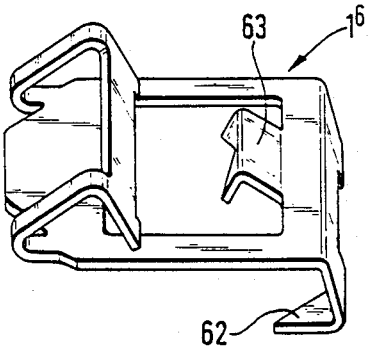
FIG. 7 shows a sixth embodiment of a fastener.

Illustrated in FIGS. 5–7 are the fasteners $1^4$, $1^5$ and $1^6$ which exhibit at their respective ends a hook-shaped connecting device 42, 52, 62 formed from a fastener plate 41, 51, 61, which device is preferably constituted by a hook or a device with similar form and function.

The fasteners $1^5$, $1^6$ also exhibit actuation mechanisms 53, 63, for example in the form of an opening 53 or an arm 63, which lend themselves to actuation for the purpose of raising the buckle $1^5$, $1^6$ in order to release the towing devices in question.

Figure 9:
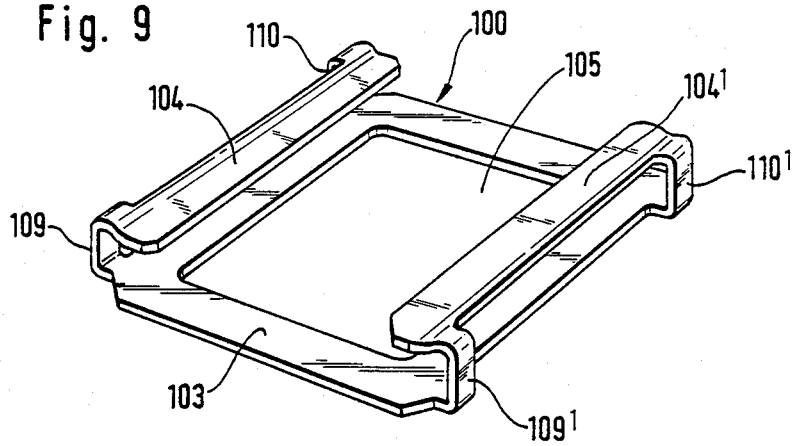
FIG. 9 shows a perspective view of a seventh embodiment of a fastener.
Figure 10:
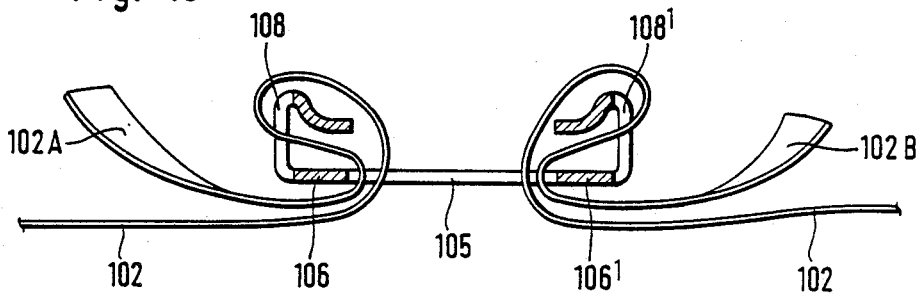
FIG. 10 shows a section through said fastener.
Figure 11:
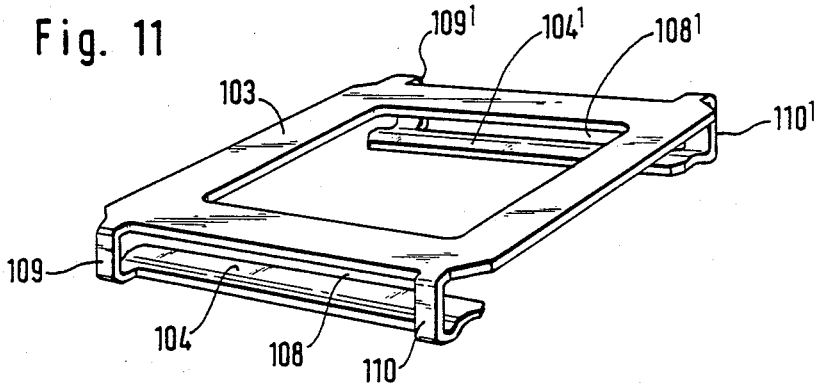
FIG. 11 shows a fastener viewed from its under side.

Illustrated in FIGS. 9–11 is a further illustrative embodiment of an arrangement for a fastener 100 for a towing device, which fastener differs from previously described fastener devices 1-1$^6$ primarily with regard to its uprights 109, 110, $109^1$, $110^1$ and its form. Said proposed fastener 100 comprises, for example, two parallel direction-changing bars 104, $104^1$ held at a certain distance from one another, which bars are situated to either side of an unobstructed space 105 extending through the plate 103 of the fastener. Straining devices 102 are so arranged as to be clamped by the fastener 100 by their parts 102A, 102B, after each of these have been passed around their respective bars 104, $104^1$, and to be released from same in a fashion similar to that used for the above previously-described fasteners. The uprights 109, 110, $109^1$, $110^1$ are so dimensioned as to be capable, of their own accord and without the need for additional support, of supporting the bars 104, $104^1$ in question at a level above said unobstructed space 105 in the fastener. Said uprights 109, 110, $109^1$, $110^1$ extend, for example, essentially at right angles outwards from said plate 103, in conjunction with which a cavity 108, $108^1$ is formed between the respective pairs of uprights 109–110 and $109^1$–$110^1$ and bars 104 and $104^1$, through which the strap parts, etc., 102A, 102B are passed before being passed back throuh said unobstructed space 105 and back around the associated clamping stops 106, $106^1$. In spite of the fact that the fastener 100 is subjected to maximum load, the bars 104, $104^1$ remain supported at the correct level above the unobstructed space 105 in the fastener, so that the parts 102A, 102B concerned of the towing device can be passed freely around the bar 104, $104^1$ in question without the risk of the bars 104, $104^1$ approaching the plate 103 and the unobstructed space 105 of the fastener.

The invention is not restricted to the illustrative embodiments described above and illustrated in the drawings, by may be varied within the scope of the Patent Claims without departing from the idea of invention.

I claim:

1. A releasable buckle for connecting a pair of straining devices together, comprising a flat metallic plate consisting of a pair of spaced side members interconnected by a pair of parallel clamping stop bars, each of said clamping stop bars having a pair of spaced uprights extending outwardly and joined together by a direction-changing bar, said uprights extending slightly beyond said direction-changing bar to define a pair of stop supports, said spaced side members and said clamping stop bars defining therebetween a space for passage of said pair of straining devices, each of said pair of uprights, said direction-changing bar and said clamping stop bar defining a cavity for passage of a respective straining device therethrough wherein a side of each clamping stop bar facing the cavity is provided with a tongue set outwardly out of said plate in a direction opposite to the adjacent respective pair of uprights, each pair of said uprights being bent outwardly of said plate and over its respective said clamping stop bar, said respective direction-changing bar being bent downwardly from its respective said pair of uprights toward said side members to position said respective stop supports on said side members.

2. A buckle according to claim 1, wherein each pair of said uprights extend at an angle inwards over the plate, preferably at approximately 45°.

3. A buckle according to claim 1, wherein edges of the clamping stop bars and the direction-changing bars interacting with the straining devices are provided with protective parts.

4. A buckle according to claim 1, wherein said protective parts are formed and bent from the metallic plate.

* * * * *